US006722520B2

(12) United States Patent
Hupp et al.

(10) Patent No.: US 6,722,520 B2
(45) Date of Patent: Apr. 20, 2004

(54) CONTAINER INCLUDING A SLIDER AND A RECLOSABLE FASTENER

(75) Inventors: Matthew Todd Hupp, Cincinnati, OH (US); Daniel Raymond Cerone, West Chester, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 0 days.

(21) Appl. No.: 09/997,108

(22) Filed: Nov. 29, 2001

(65) Prior Publication Data

US 2002/0033396 A1 Mar. 21, 2002

Related U.S. Application Data

(63) Continuation-in-part of application No. 09/481,456, filed on Jan. 11, 2000.

(51) Int. Cl.[7] ..... B65D 45/00

(52) U.S. Cl. ..... 220/315; 220/4.21; 220/780; 190/903; 53/139.2; 24/387; 383/64

(58) Field of Search ..... 220/780, 315, 220/784, 4.21; 53/139.2; 190/903; 24/387; 383/64

(56) References Cited

U.S. PATENT DOCUMENTS

| | | | | |
|---|---|---|---|---|
| 2,629,911 A | | 3/1953 | Macy | |
| 2,665,467 A | | 1/1954 | Bosomworth et al. | |
| 2,736,079 A | | 2/1956 | Staller et al. | |
| 2,756,172 A | | 7/1956 | Kidd | |
| 2,972,792 A | | 2/1961 | Johnson | |
| 3,660,875 A | | 5/1972 | Gutman | |
| 3,784,055 A | | 1/1974 | Anderson | |
| 3,967,756 A | | 7/1976 | Barish | |
| D285,748 S | * | 9/1986 | Feinberg et al. | D3/286 |
| 4,773,515 A | * | 9/1988 | Kotkins, Jr. | 190/103 |
| 5,062,186 A | | 11/1991 | Rampolla et al. | |
| 5,636,783 A | | 6/1997 | Preston | |
| 5,662,758 A | | 9/1997 | Hamilton et al. | |
| 5,871,607 A | | 2/1999 | Hamilton et al. | |
| 5,965,235 A | | 10/1999 | McGuire et al. | |
| 6,092,266 A | * | 7/2000 | Lee | 24/389 |
| 6,092,687 A | * | 7/2000 | Hupp et al. | 220/666 |
| 6,194,062 B1 | | 2/2001 | Hamilton et al. | |
| 6,276,501 B1 | * | 8/2001 | Tong | 190/107 |
| 6,394,299 B1 | * | 5/2002 | Hupp | 220/315 |

* cited by examiner

*Primary Examiner*—Stephen K. Cronin
*Assistant Examiner*—James Smalley
(74) *Attorney, Agent, or Firm*—David K. Mattheis; Stephen T. Murphy; David M. Weirich

(57) ABSTRACT

A container has a rigid, elongate reclosable fastener, a slider and a track for the slider. The track defines a travel path lying in more than one plane. The travel path has vector components extending in each of mutually orthogonal X, Y and Z directions. The slider is slidably attached to the reclosable fastener and moved along the track to open and close the reclosable fastener.

26 Claims, 10 Drawing Sheets

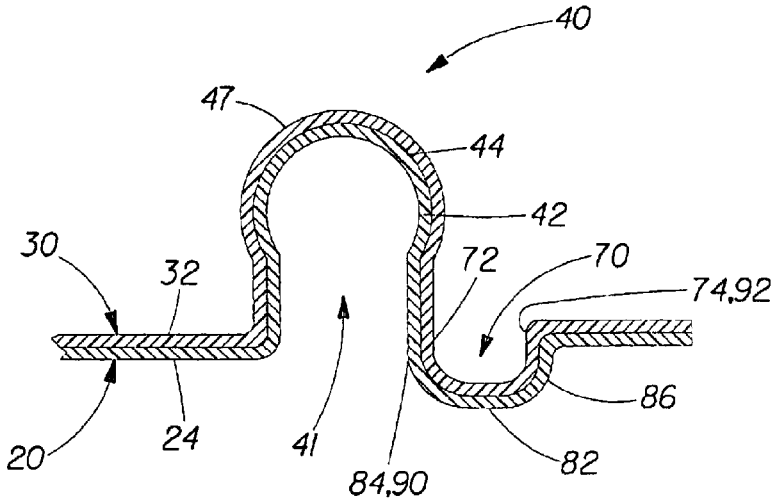
Fig. 2a
Fig. 2b
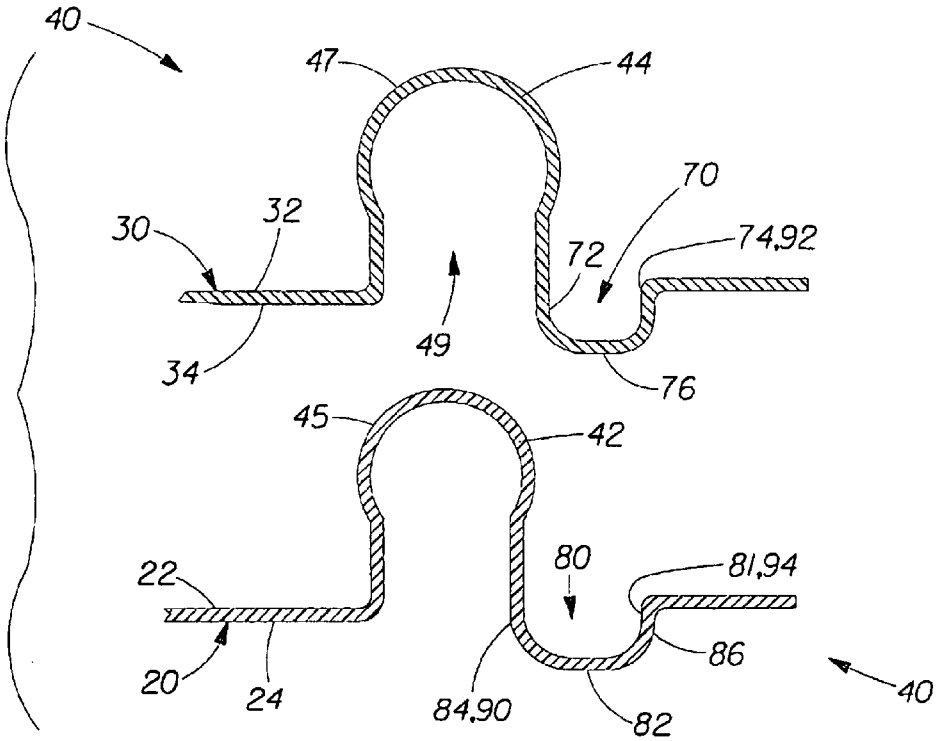

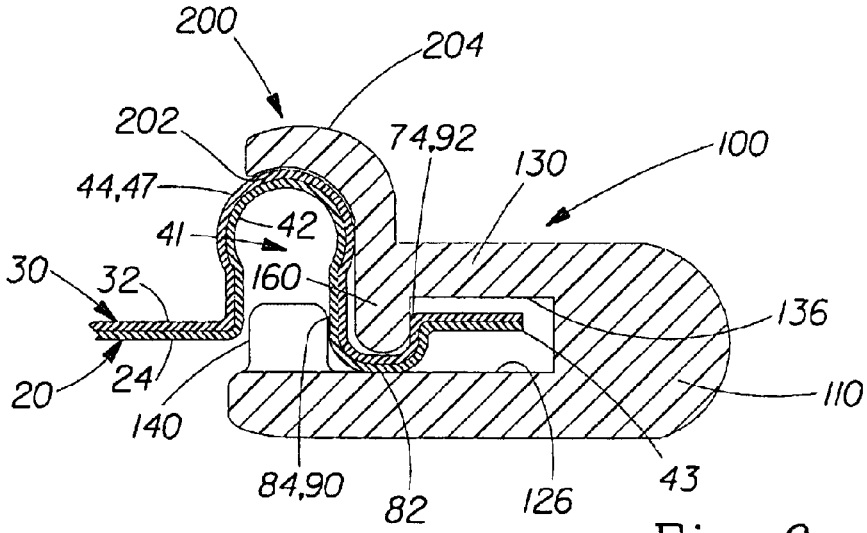
Fig. 6a
Fig. 6b
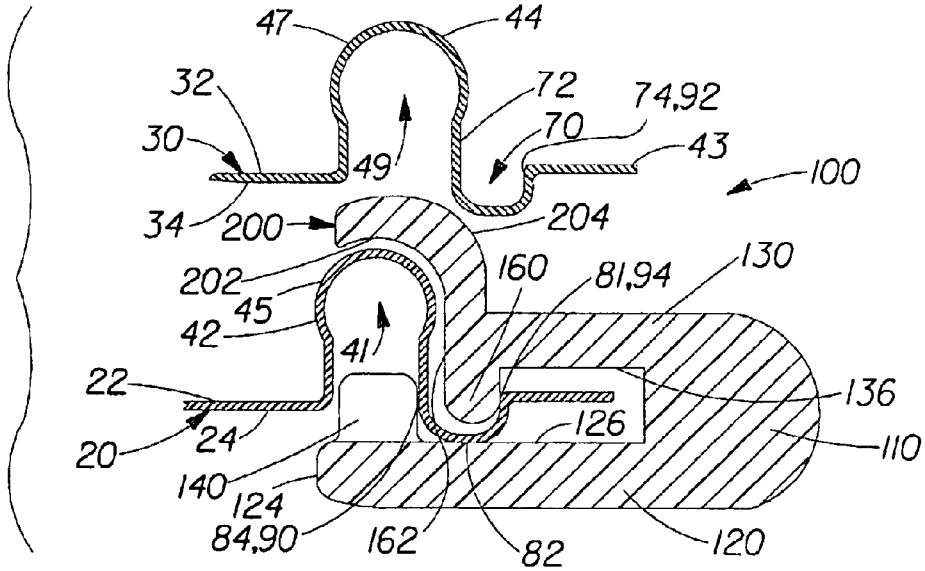

CONTAINER INCLUDING A SLIDER AND A RECLOSABLE FASTENER

The current application is a continuation-in-part (CIP) of application Ser. No. 09/481,456 filed Jan. 11, 2000.

FIELD OF THE INVENTION

The invention relates to containers including a slider and a particularly rigid, elongate reclosable fastener, wherein the slider is particularly moved along a travel path having vector components extending in each of mutually orthogonal X, Y and Z directions.

BACKGROUND

Flexible storage bags for use in the containment and protection of various items, as well as the preservation of perishable materials such as food items, are well known in the art. Such bags typically comprise an elongate reclosable fastener such as an interlocking rib-type seal integrally formed with the bag, to seal contents disposed in the bag. Sliding closure mechanisms, which utilize a sliding plastic sleeve to bias interlocking ribs into and out of engagement, have become popular due to their comparative ease of operation and visual and tactile confirmation that the seal formed by the reclosable fastener has been successfully completed.

Rigid and semi-rigid containers are also well known in the art. Such containers have realized a fair degree of commercial success in providing a means for storing a wide variety of contents. These containers typically incorporate lids which are usually sealed to the container by a reclosable fastener comprising interlocking protruded and recessed elements such as bulbs and grooves. Additionally, U.S. Pat. No. 3,784,055 issued Jan. 8, 1974 to Anderson, and U.S. Pat. No. 3,967,756 issued Jul. 6, 1976 to Barish, both of which are incorporated herein by reference, disclose containers utilizing plug seals.

While such mechanical closures can be effective in preserving container contents, some consumers experience difficulty in fully completing the closure operation and confirming for themselves that a satisfactory closure has been achieved. This is particularly so when the physical change in position of the cover between interlocked and non-interlocked positions is comparatively small.

Traditional sliders used with reclosable fasteners on flexible storage bags assure the user that the fastener is opened or closed during use, however, such sliders typically embody sidewalls limiting their operation to unidirectional fasteners. An example of a traditional type slider is illustrated in U.S. Pat. No. 3,660,875 issued May 9, 1972 to Gutman, and incorporated herein by reference. Since rigid and semi-rigid containers typically incorporate lids sealed by fasteners extending in directions having vector components extending in two or three mutually orthogonal directions, the traditional sliders are unsuitable for opening or closing such fasteners.

Accordingly, it is desirable to provide containers including a slider for opening or closing a reclosable fastener wherein the slider is moved in a three dimensional travel path defined by mutually orthogonal directions. Particularly, it is desirable to provide containers including a slider that is slidably attached to the reclosable fastener and capable of easily and effectively opening or closing the fastener and pivoting around corners joining substantially orthogonal sections or curvilinear segments of the fastener. More particularly, it is desirable to provide containers including a slider having the aforementioned attributes that can effectively open and close the reclosable fastener requiring minimal maneuvering by the consumer other than moving the slider along the fastener.

SUMMARY OF THE INVENTION

In one embodiment, the containers according to the invention comprise a rigid, elongate reclosable fastener, a slider and a track for the slider. The track defines a travel path lying in more than one plane. The travel path has vector components extending in each of mutually orthogonal X, Y and Z directions. The slider is slidably attached to the reclosable fastener and moved along the track to open and close the reclosable fastener.

In another embodiment, the containers according to the invention comprise a slider, a container body and a cover, wherein the body of the container is adapted to receive the cover. The body includes a flange having a protruding element, and a track. At least a portion of the slider is disposed in the track. The slider is adapted to close the cover on the container body when moved in a first direction along the track and adapted to open the cover from the container body when moved in a second direction opposite the first direction along the track.

In an additional embodiment, the invention is directed to containers comprising a cover, a container body, a reclosable fastener, a track and a slider. The reclosable fastener is disposed between the cover and the container body and is adapted to provide a seal therebetween. The track defines a travel path lying in a three dimensional space defining orthogonal X, Y and Z directions. The track is arranged at least partially congruent with the reclosable fastener. At least a portion of the slider is disposed in the track and moved along the travel path to seal or unseal the reclosable fastener In yet another embodiment, the invention is directed to a rigid, elongate reclosable fastener including interlocking protruded and recessed portions, a slider and a track for the slider. The track defines a travel path lying in more than one plane. The travel path has vector components extending in each of mutually orthogonal X, Y and Z directions. The slider is slidably attached to at least one of the interlocking portions and moved along the track to open and close the reclosable fastener.

The reclosable fasteners and containers according to the invention provide a convenient manner for opening and closing containers having an opening extending in more than one plane. These and additional advantages provided by the present invention will be more fully apparent in view of the following detailed description.

BRIEF DESCRIPTION OF THE DRAWINGS

While the specification concludes with claims particularly pointing out and distinctly claiming the present invention, it is believed that the present invention will be better understood from the following description in conjunction with the accompanying drawing figures, in which like reference numerals identify like elements, and wherein:

FIG. 2*a* is a cross sectional view of interlocking elements of the elongate reclosable fastener closing the cover to the flange of the container depicted in FIGS. 1*a* or 1*b*.

FIG. 2*b* is a cross sectional view of the elongate reclosable fastener depicted in FIG. 2*a* showing the interlocking elements separated in an open configuration.

FIG. 6*a* is a cross sectional view of the closing end of the slider depicted in FIGS. 5*a*–5*c* shown slidably attached to a reclosable fastener in the closing configuration.

FIG. 6*b* is a cross sectional view of the opening end of the slider depicted in FIGS. 5*a*–5*c* shown slidably attached to a reclosable fastener in the opening configuration.

DESCRIPTION

As used herein, the following terms have the following meanings:

X, Y, and Z are coordinates defining perpendicular directions intersecting one another at right angles at an origin.

Rigid means deficient or devoid of flexibility; appearing stiff and unyielding, remaining unaltered when typical in-use forces are applied.

A reclosable fastener is a fastener that is selectively openable and reopenable and, optionally, sealable and resealable.

The present invention pertains to a container having a slider suitable for opening or closing an elongate rigid reclosable fastener. The container of the present invention particularly includes a rigid, elongate reclosable fastener, a slider and a track, the track lying in more than one plane thereby requiring the slider to travel along a three dimensional path. The three dimensional travel path may be defined by mutually orthogonal X-Y, X-Z and Y-Z planes whereby the path has vector components in the X, Y and Z directions. The vector components in the X, Y and Z directions may include vectors running within the three dimensional space having X, Y, and Z components acute to any or all of the three orthogonal planes.

Figure 1A:
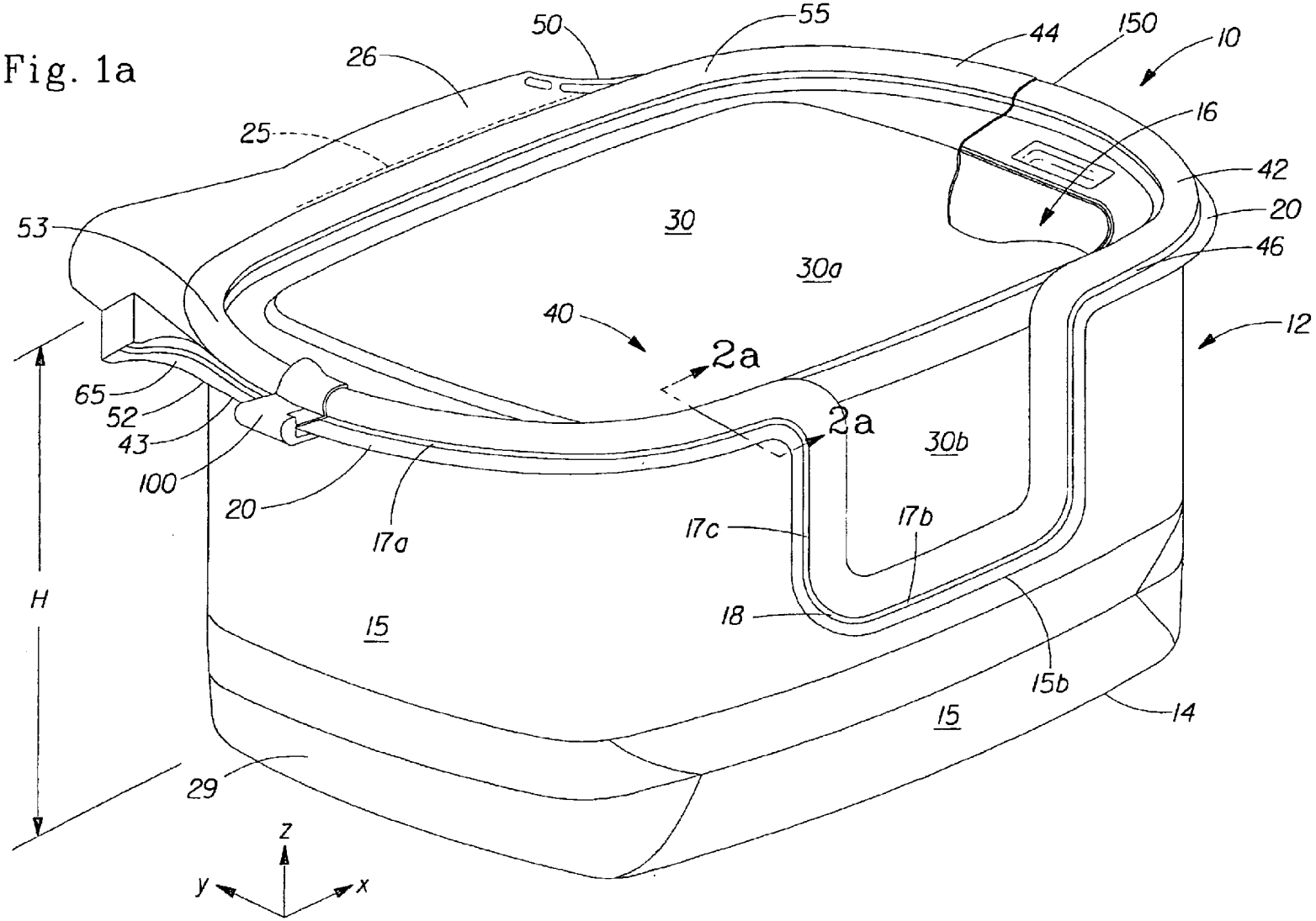
FIG. 1*a* is a perspective view of a first embodiment of a container according to the invention incorporating a slider for opening or closing a reclosable fastener attaching a cover to a container body.

More particularly, the containers according to the present invention are suitable for opening or closing by means of a rigid, elongated reclosable fastener and a slider wherein the slider travels in a track lying in multiple planes, i.e. two or more planes, along a path of travel. The reclosable fastener is closable or fastenable, optionally sealable in a direction orthogonal to the travel path, whereby, as the slider moves along the track, the slider imparts forces to the fastener in an orthogonal direction to open or close the fastener. As illustrated in FIG. 1*a*, an example of such a reclosable fastener 40 is shown fastening or sealing a cover 30 to the flange 20 on a body of a container 10. The present invention is also suitable for use as a reclosable fastener, along with the slider, in other applications such as to fasten a sleeve.

The container 10 according to the present invention and as depicted in FIG. 1*a* may be relatively small, such that the container 10 may be stored in one's pocket or purse. Such a container 10 may be useful for storing pills, capsules, etc. Alternatively, the container 10 may be relatively large such that the container 10 is sized to fit a flat bed semi-truck. Such a container 10 may be useful for carrying construction materials, etc. One contemplated use for the container 10 is to store perishable items such as food.

In the embodiment depicted in FIG. 1*a*, the container 10 includes a container body 12 which may be unitarily formed from a piece of sheet material. The container body 12 may have a planar or domed shaped bottom side 14 defining an X-Y plane, an opening 16, four sidewalls 15, and a flange 20 circumscribing the opening 16. The container 10 also includes a cover 30 for covering the opening 16.

In one embodiment as shown in FIG. 1*a*, the top edges, such as 15*a* and 15*b*, of the four sidewalls do not all lie in a single plane. The cover 30 may extend in at least two planes and is illustrated as having two substantially perpendicular surfaces 30*a*, 30*b*. The flange 20 on the container body 12 aligns with the perimeter of the cover 30. The flange 20 and the cover 30 may be shaped concave and/or convex relative to the bottom side 14 and/or the respective opposing sidewalls.

Various compositions suitable for constructing the containers 10 of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 10 mil (0.25 millimeters) thickness, commercially available from Chevron under the manufacturer's designation PE1122 or syndiotactic polypropylene available from Fina Corp. under the designation EOD96-28 of 20 mil (0.5 millimeters) thickness. Further suitable materials include a polyethylene/polypropylene blend. Wood and metal may be used for larger size containers 10.

Although the container body 12 illustrated in FIG. 1*a* has four sidewalls 15, the body may actually comprise three or more sidewalls or may be round or oval. In addition, although the opening 16 in the container illustrated in FIG. 1*a* is disposed partially opposite the bottom side 14, the invention is applicable to openings disposed on any side or sides of the container.

The flange 20 may be either unitarily formed with the container body 12 or provided as a separate material joined to the container body 12. When provided as a separate, preferably more rigid material element, it is preferred that the remainder of the container body 12 material be formed into at least a small peripheral flange 20 at its upper edge (defining the opening 16) with pleated comers so as to form a suitable junction point for joining the container body 12 to the flange 20. The cover 30 may be either unitarily formed with the container body 12 or at least hingedly attached to the flange 20 at a hinge line 25 of a hinge 26. The hinge 26 may comprise a unitary living hinge or be provided as a line of weakness by scoring, perforations, or the like which may optionally permit the cover 30 to be separated from the container body 12. While a hinged embodiment is shown, embodiments without hinges are contemplated.

The reclosable fastener 40 may circumscribe or partially enclose the container opening 16. The reclosable fastener 40 may comprise any type of reusable mechanical fastener or seal known in the art. It is preferred that the reclosable fastener provides a liquid impervious seal, although non-sealing reclosable fasteners are also contemplated. Suitable seals include, for example, friction fit seals, compression fit fin seals, adhesive seals, cohesive seals, and selectively activatable adhesives as illustrated by commonly assigned U.S. Pat. No. 5,662,758, issued Oct. 2, 1997 in the names of Hamilton et al., U.S. Pat. No. 5,871,067, issued Feb. 16, 1999 in the names of Hamilton et al., application Ser. No. 08/745,339, filed Nov. 8, 1996 in the name of McGuire et al., and application Ser. No. 08/745,340, filed Nov. 8, 1996 in the name of Hamilton et al., all of which are incorporated herein by reference. By reusable, it is meant that the cover 30 of the container 10 may be reversibly transformed between each of the open and closed positions at least two times and still functionally fasten or seal the container 10.

In the embodiment shown in FIG. 1*a*, the reclosable fastener 40 comprises mechanical interlocking elements 42, 44 in which at least one protruded element 42 interlocks with at least one recessed element 44 to form a closure or, alternatively, a seal. The two interlocking elements 42, 44 circumscribe the container opening 16, occupying a marginal portion of the cover 30 and a marginal portion of the flange 20. The interlocking elements 42, 44 are preferably spaced a substantially constant distance inwardly from the peripheral edge of the cover 30 and flange 20 enabling a slider 100 having an adequate inward extent to be drawn along a track 46 at the peripheral edge without leaving gaps or unsealed portions.

Figure 1B:
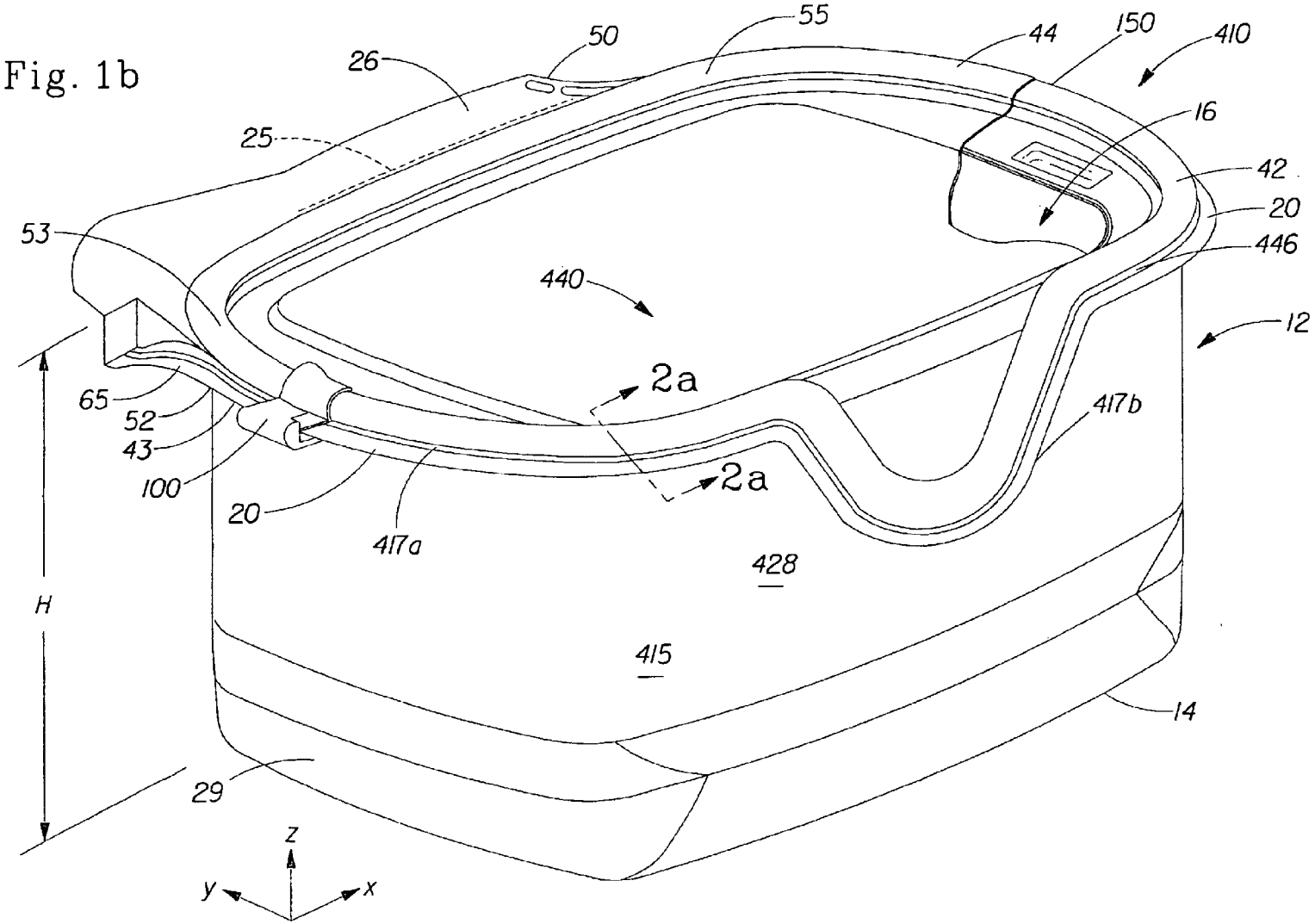
FIG. 1*b* is a perspective view of a second embodiment of a container according to the invention incorporating a slider for opening or closing a reclosable fastener attaching a cover to a container body.

In an alternative embodiment of the current invention such as shown in FIG. 1*b*, the container 410 includes a pour spout 428. The pour spout 428 extends from the sidewall 415 which is opposite the sidewall (not shown) having the hinge line 25. The pour spout is closed or, optionally, sealed by the reclosable fastener as described herein. The opening of the pour spout 428 (not shown at the pour spout 428 because hidden by cover 430) may both protrude from the sidewall 415 and have a top perimeter or edge adjacent the top perimeter 417*b* of cover 430 that is lower than a height H of one or more of the remaining sidewall top edges 417*a*. In alternative embodiments, the pour spout can be on any sidewall or even between adjacent sidewalls, i.e. on a corner. An additional embodiment of the pour spout may include having a hinge on the cover opposite the top edge of the pour spout. In more alternative embodiments the pour spout may be adapted to fit a cylindrical container or any other similarly shaped container as would be obvious to one skilled in the art.

Also shown in FIG. 1*a*, the container body may optionally include a collapsible portion 29. The collapsible portion 29 may conveniently be collapsed to decrease the need for storage space and extended to increase the volume of the storage volume inside the container. In one embodiment, the container 10 has a height lying in the Z direction. The travel path may extend in the Z direction a distance less than the height H of the container, such as shown in FIG. 1*a*. In such an embodiment, the collapsible portion 29 is limited to a height below the track 46.

As illustrated in FIGS. 2*a* and 2*b*, the protruded element 42 may have a bulbous shape and the recessed element 44 may comprise a groove 49 shaped complementary to the protruded element 42. The interlocking elements 42, 44 are disposed on mating portions of the flange 20 and cover 30, respectively. The protruded element 42 may be unitarily formed with the flange 20 extending upwardly from the top side 22 of the flange 20 while the recessed element 44 may be uniformly formed with the cover 30 having a bulbous non-interlocking surface 47 extending upward from the top side 32 of the cover 30 or vice versa. The recessed element 44 is open on the bottom side 34 of the cover 30 so as to receive the protruded element 42 therein while the protruded element 42 is open at 41 on the bottom side 24 of the flange 20.

The slider 100 depicted in FIGS. 1*a* and 1*b* has a generally C-shaped configuration with ends of the slider 100 straddling the peripheral edges of the flange 20 or 420 and cover 30 or 430 in overlying relation enabling portions of the slider 100 to interface with the interlocking elements 42, 44 of the reclosable fastener 40. One portion of the slider 100 which interfaces with interlocking elements 42, 44 has a spacing therebetween which is sufficiently small as to bias the elements into interlocking engagement when the slider 100 is translationally drawn in a first direction over a region of the periphery where the elements are separated. Other portions of the slider 100 urge the interlocked elements 42, 44 apart as the slider 100 moves in a second direction opposite the first direction, applying separating forces.

The container includes a track 46, 446 which defines a continuous travel path having vector components extending in each of the X, Y and Z directions and extending from an opened end 50 to a closed end 52 for directing the motion of the slider 100 along the fastener 40, 440. The track 46, 446 may be disposed at least partially congruent with the reclosable fastener 40, 440. The slider 100 may be disposed in the track 46, 446, thus distinguishing the slider 100 of the present invention from and insuring the slider 100 of the present invention does not include an ordinary zipper.

In the exemplary embodiment depicted in FIG. 1*a*, the track 46 may have a travel path lying three dimensionally. One sector (run of track in a similar direction and same plane) defining a portion of the travel path is positioned at an angle with respect to a plane defined by at least one other sector of the travel path. For example, sectors 17*a*, 17*b*, and 17*c* of the travel path run in mutually perpendicular directions substantially parallel to the X, Y and Z directions, respectively. The sectors may be joined via a transition region which may comprise an arc. The arc may be two dimensional or, alternatively, the arc may extend in the X-Y plane, X-Z plane and/or in the Y-Z plane, thereby defining a three dimensional travel path.

Other embodiments, and as depicted in FIG. 1*b*, may have arcs along a transition region having points of tangency with vector components acute to the X, Y and Z direction. Similarly, the pour spout 428 in FIG. 1*b* defines a plane or sector 417*b* that lies acute to the orthogonal X-Y, X-Z and Y-Z planes. In other embodiments, for example, the track 46 may be entirely curvilinear having an oval shape where the travel path breaks across the X-Y plane to the X-Z plane. In yet another embodiment, the track 46 may have a series of arcuate sectors forming a path having a wavy pattern such as a sinusoidal shape.

Figure 3:
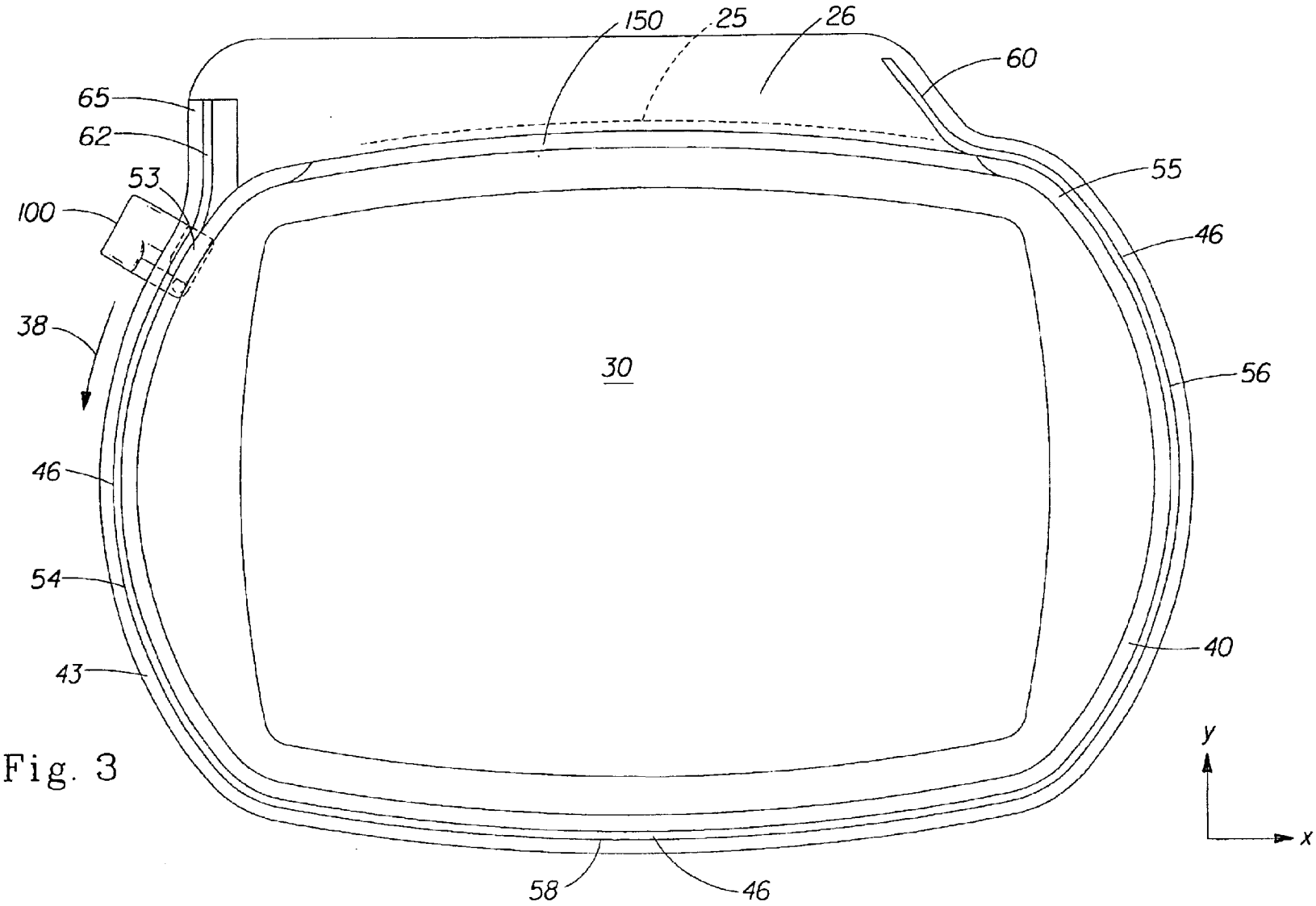
FIG. 3 is a top view of the container depicted in FIG. 1*a* showing the travel path of the slider and a first direction of travel which closes the reclosable fastener.
Figure 4:
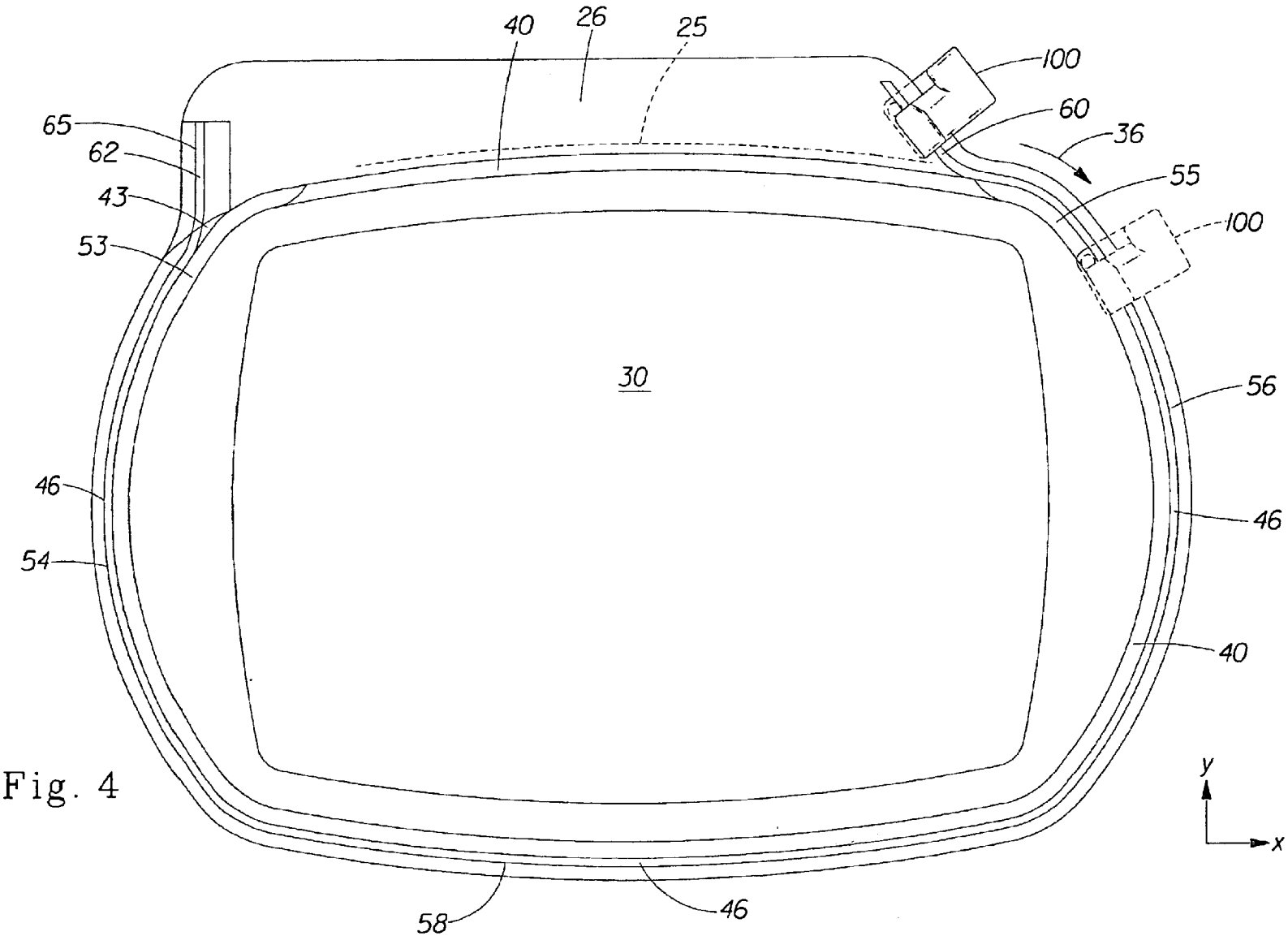
FIG. 4 is a top view of the container depicted in FIG. 1*a* showing the travel path of the slider and a second direction of travel which opens the reclosable fastener.

FIGS. 3 and 4 show top views of the container depicted in FIG. 1*a*. The track 46 is congruent with the reclosable fastener 40 along the edges of the cover 30 and flange 20 except for the edges occupied by the hinge line 25. The track 46 runs from one side of the hinge line 25 from the opened end 50 of the fastener to the closed end 52 at the other side of the hinge line 25.

In the configuration shown in FIGS. 3 and 4, the track 46 has a fastening portion and auxiliary tracks. The fastening portion comprising two opposing arcs 54, 56 curving in a concave direction towards the center of the container, joined by a predominantly straight, although slightly curved sector 58 opposite the hinge line 25. As the track 46 approaches the open end 50 of the fastener near the hinge line 25, the track 46 diverts away from the fastener in order to direct the slider 100 to a first auxiliary track 60 for parking the slider 100. Likewise, as the track 46 approaches the closed end 52 near the hinge line 25, the track 46 diverts away from the fastener 40 in order to direct the slider 100 to a second auxiliary track 62 for parking the slider 100. The auxiliary tracks enable the cover 30 to rotate about the hinge line 25 or be removed from the container without interfering with the slider 100.

As illustrated in FIG. 2*a*, when in the closed configuration, the track 46 can comprise a slot 70 in the top side of the cover 30 congruent with the recessed element 44 of the reclosable fastener 40. The cover slot 70 includes an inside edge 72 nearest the recessed element 44 and an outside edge 74 opposite the inside edge 72. As shown in FIG. 2*b*, the cover slot 70 in the top side 32 of the cover 30 forms a bead 76 on the bottom side 34 of the cover 30 which interfaces with a complementary flange slot 80 in the top side 22 of the flange 20 congruent with the protruded element 42 of the reclosable fastener 40. The flange slot 80 in the top side 22 of the flange 20 protrudes through the flange 20 forming a bead 82 on the bottom side 24 of the flange 20. The bead 82 on the bottom side 24 of the flange 20 includes an inside edge 84 nearest to the opened end 41 of the protruded element 42 and an outside edge 86 opposite the inside edge 84. The track 46 may be defined, at least partially, as the cover slot 70 when the slider is moved in the closing or first direction 36. The track 46 may be defined as the flange slot 80 when the slider is moved in the opening or second direction 38 or when the slider 100 is parked.

As seen generally in FIGS. 2*a* and 2*b*, the inside edge 84 of the bead 82 on the bottom side 24 of the flange 20 generally defines a first edge 90 of the track 46 for the slider embodiments described hereunder. In one slider embodiment, the outside edge 81 of the flange slot 80 in the top side 22 of the flange 20 forms the second edge 94 of the track 46 when such slider is disposed in the opening mode whereas the outside edge 74 of the cover slot 70 in the top side 32 of the cover 30 forms the second edge 92 of the track 46 when such slider is disposed in the closing mode. In another embodiment, the outside edge 74 of the cover slot 70 in the top side 32 of the cover 30 defines second edge 92 of the track 46 when the slider is disposed in both the opening and the closing modes.

Figure 5A:
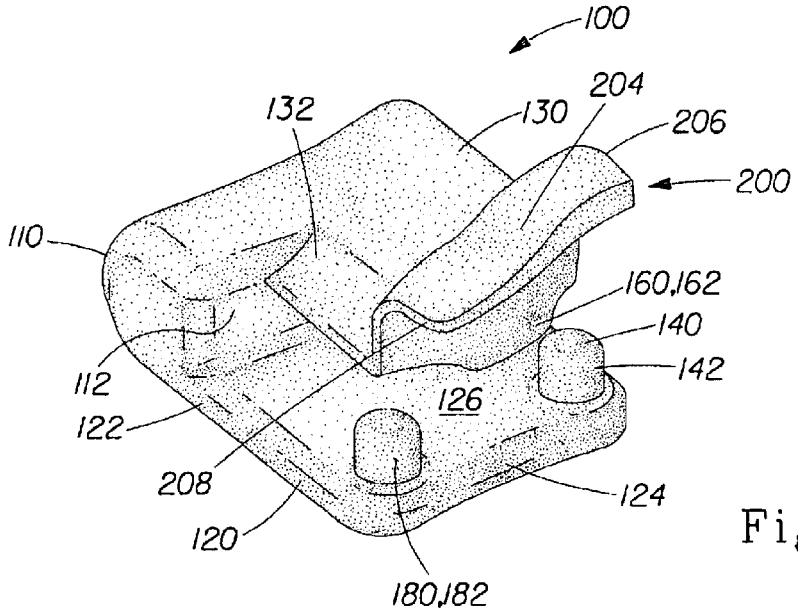
FIG. 5*a* is a perspective view of one embodiment of a slider included in a container according to the present invention.
Figure 5B:
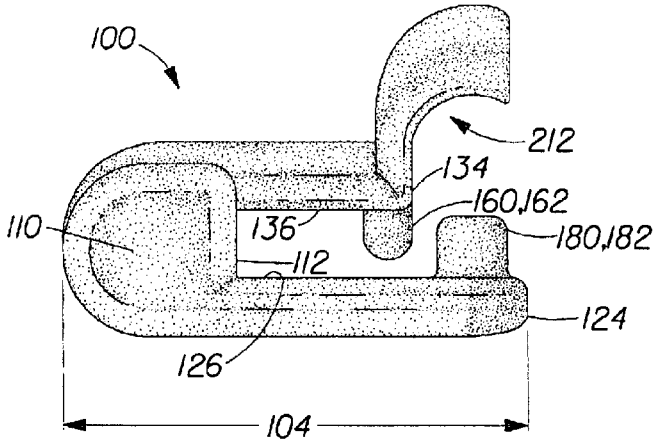
FIG. 5*b* is side view along the width of the slider depicted in FIG. 5*a* showing the closing end of the slider.
Figure 5C:
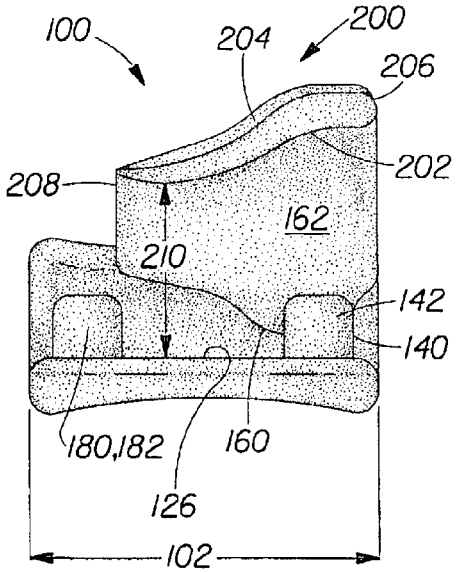
FIG. 5*c* is a side view along the length of the slider depicted in FIG. 5*a*.

As illustrated in FIGS. 3 and 4, the slider 100 is slidably attached to the track 46 and moveable along the travel path defined by the track 46. As shown in FIGS. 5*a*, 5*b*, and 5*c*, the slider 100 has a length 102 running substantially parallel to the track and a width 104 running substantially orthogonal thereto. The C-shaped body of the slider 100 comprises a base 110 having a first surface 112 with first and second elongate members 120, 130 extending therefrom in a side-by-side arrangement. The first and second elongate members 120, 130 each have proximal ends 122, 132 depending from the first surface 112 of the base 110, distal ends 124, 134 extended away from the first surface 112 and opposing internal surfaces 126, 136. The first elongate member 120 includes a pivot 140 depending from the internal surface 126 at the distal end 124 projecting towards the second elongate member 130. The second elongate member 130 includes a tracking member 160 depending from the internal surface 136 at the distal end 134 projecting towards the first elongate member 120.

The tracking member 160 may be aligned with the pivot 140 along the length 102 of the slider 100 and along the width 104 of the slider 100. Alternatively, the tracking member 160 may be offset from the pivot 140 along the length 102 of the slider and along the width 104 of the slider 100. Preferably, as shown in FIGS. 5*a*–5*c*, the tracking member 160 is offset from the pivot 140 along the width 104 of the slider 100 and aligned with the pivot 140 along the length 102 of the slider 100.

In the embodiments of the figures, the first and second elongate members 120, 130 straddle the peripheral edges of the cover 30 and flange 20 while the pivot 140 and tracking member 160 interface with the interlocking elements of the fastener 42, 44. Particularly, the pivot 140 may interface with the opened end 41 of the protruded element 42 on the bottom side 24 of the flange 20 and the tracking member 160 may interface with the non-interlocking surface 47 of the recessed element 44 on the top side 32 of the cover 30.

In the assembled configurations illustrated in FIGS. 6*a* and 6*b*, the first and second elongate members 120, 130 straddle the peripheral edges of the cover 30 and flange 20 as the pivot 140 and tracking member 160 interface with the slot 70 on the top side of the cover 30 and the bead on the bottom side 24 of the flange 20. Particularly, in the closing mode shown in FIG. 6*a*, the tracking member 160 is disposed against the outside edge 74 of the slot 70 in the top side of the cover 30 while the pivot 140 butts against the inside edge 84 of the bead 82 on the bottom side 24 of the flange 20. In the opening mode illustrated in FIG. 6*b*, the tracking member 160 is disposed against the outside edge 81 of the slot in the top side 22 of the flange 20 while the pivot 140 rests against the inside edge 84 of the bead 82 on the bottom side 24 of the flange 20.

The pivot 140 enables the slider 100 to rotate about the distal end 124 of the first elongate member 120, particularly along curvilinear sectors and transition regions having vector components extending in the X, Y and Z directions. For this reason, the pivot 140 comprises an oval, preferably cylindrical external surface (shown as 142 in FIG. 5*a* and 5*c*) which interfaces with the track 46. This enables the base 110 of the slider 100 to rotate relative to distal ends of the elongate members as the slider 100 moves along the curvilinear or three dimensional sectors of the travel path.

The tracking member 160 generally maintains the attachment of the slider 100 to the track 46 and guides the slider 100 along the travel path. In one embodiment, external surface 162 of the tracking member 160 is convex in shape in order to minimize frictional contact with the track 46. However, in the illustrated embodiment seen in FIGS. 5*a*–5*c*, the tracking member 160 may also serve as a pivot particularly at the transition region of the track 46 or where the travel path may otherwise take on a wavy pattern such as a sinusoidal shape. Such configurations may require both the base 110 and the distal ends of the elongate members to rotate relative to one another depending upon the slider 100 location along the travel path. In an embodiment where the tracking member 160 is required to function as a pivot, the external surface 162 may be oval or cylindrical.

Although rotation of the slider 100 is desirable, particularly in transition regions along the travel path, it may be necessary to maintain proper orientation of the slider 100 relative to the reclosable fastener 40 to ensure that portions of slider 100 interfacing with the interlocking elements 42, 44 are properly oriented relative to the fastener. This may enable the slider 100 to operate more effectively in opening and closing the fastener. For instance, proper orientation of the slider 100 may include the length 102 of the slider 100 being substantially parallel to the travel path while the width 104 is substantially orthogonal thereto. Such an orientation can be maintained by a rotation restraint 180, as seen in FIGS. 5*a*–5*c*, disposed on the slider 100 that interfaces with the reclosable fastener 40 or the track 46.

Although the rotation restraint 180 may comprise a number of different configurations to control the rotation of the slider 100, the rotation restraint 180 for the slider illustrated in FIGS. 5*a*–5*c* comprises a pin 182 disposed on the internal surface 126, at the distal end 124 of the first elongate member 120 projecting towards the second elongate member 130. As shown, the pin 182 is spaced apart from the pivot 140 along the length 102 of the slider 100 and in alignment with the pivot 140 along the width 104 of the slider 100. Like the pivot 140, the pin 182 interfaces with the track 46 by resting against the inside edge 84 of the bead 82 on the bottom side 24 of the flange 20.

The distance between the restraint 180 and the pivot 140 is limited, depending upon the track 46, particularly on the radius of curvature of the transition regions along the travel path. The greater the radius of curvature the greater the allowable distance separating the pivot 140 and the rotation restraint 180. Likewise, the smaller the radius of curvature the smaller the allowable distance therebetween.

Like the pivot 140 and the tracking member 160, the external surface of the pin 182 is shaped to minimize frictional contact with the track 46. The external surface can have a convex shape in order to limit the interface to point contact.

As previously described, the primary function of the slider 100 is to bias the interlocking elements 42, 44 of the reclosable fastener 40 together as the slider 100 moves in a first direction 36 closing the fastener and to apply separating forces to the interlocking elements 42, 44 as the slider 100 moves in a second direction 38 opposite the first direction 36 opening the fastener. The slider generally includes features that provide these functional characteristics.

In the embodiment shown in FIGS. 5*a*–*c*, the slider 100 includes a wedge 200 disposed on the distal end 124 of the second elongate member 130, adjacent to, but opposite the tracking member 160. The wedge 200 is disposed away from the first surface 112 of the base 110 to interface with the interlocking elements 42, 44 of the reclosable fastener 40. The wedge 200 comprises an internal surface 202 and an external surface 204, an opening end 206 and a closing end 208. Spacing 210 between the internal surface 202 of the wedge 200 and the internal surface 126 of the first elongate member 120 forms a channel 212 which converges along the length 102 of the slider 100 from a maximal distance at the opening end 206 of the wedge 200 to a minimal distance at the closing end 208 of the wedge 200.

As shown, the wedge 200 can be frustoconical having a concave internal surface 202 and a convex external surface 204. In order to minimize frictional contact with the interfacing components of the fastener 40, both the internal surface and the external surface of the wedge may comprise wavy contours extending from the opening end 206 to the closing end 208. For instance, the contour of the external surface 204 may be convex relative to the travel path near the opening end 206 and concave relative to the travel path near the closing end 208 while the contour of the internal surface 202 may be concave near the opening and 206 and convex near the closing end 208.

For the slider embodiment illustrated in FIGS. 5*a*–*c*, the wedge 200 provides the function of opening and closing the reclosable fastener 40. In the closing configuration illustrated in FIG. 6*a*, the concave internal surface 202 of the wedge 200 partially encloses the bulbous non-interlocking surface 47 of the recessed element formed in the cover 30 while internal surface of the first elongate member 120 contacts the bottom side 24 of the flange 20 at the bead 82 protruding therethrough forming the track 46. As the slider 100 moves along the travel path in the first direction 36 shown in FIG. 3, the converging channel formed between the concave internal surface 202 of the wedge 200 and the internal surface 126 of the first elongate member 120 biases the interlocking elements 42, 44 together in a sealing arrangement.

Once the slider 100 travels the length of the track 46 in the first direction 36 closing the fastener, the slider 100 can be placed in the opening configuration by reversing direction and interposing the wedge 200 between the interlocking elements 42, 44. A flexible lip 43 of the cover 30 extending from the recessed element 44 of the fastener 40 at the closed end 52 of the fastener 40 may be provided to enable the wedge 200 to initiate separation of the two elements 40,42.

In the opening configuration illustrated in FIG. 6*b*, the wedge 200 is disposed between the interlocking elements 42, 44 so that the concave internal surface 202 of the wedge 200 partially encloses the interlocking surface 45 of the protruding element while the groove 49 of the recessed element encloses the frustoconical external surface 204 of the wedge 200. As the slider 100 moves in the second direction 38 illustrated in FIG. 4, the frustoconical external surface 204 of the wedge 200 urges the interlocking elements 42, 44 apart to open the reclosable fastener 40.

In the embodiment previously described, the wedge 200 performs both the opening and closing operation forcing the user to either fully open or fully close the fastener 40 before changing to the opposing operation. By providing a slider having separate components designated for opening and closing the fastener, the user can switch from the opening mode to the closing mode at any point along the travel path.

Figure 7A:
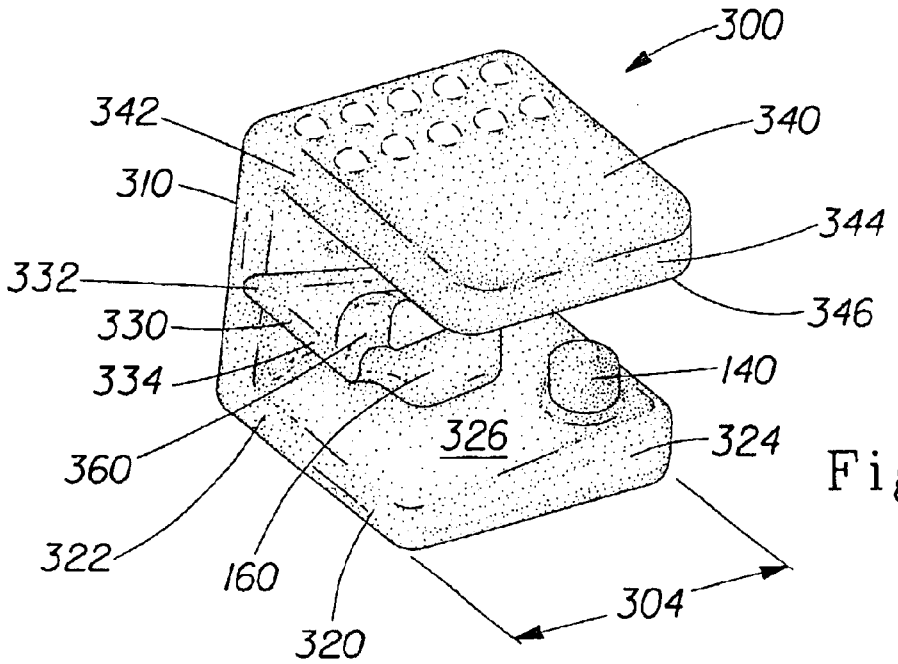
FIG. 7*a* is a perspective view of an alternate embodiment of a slider included in a container according to the present invention.
Figure 7B:
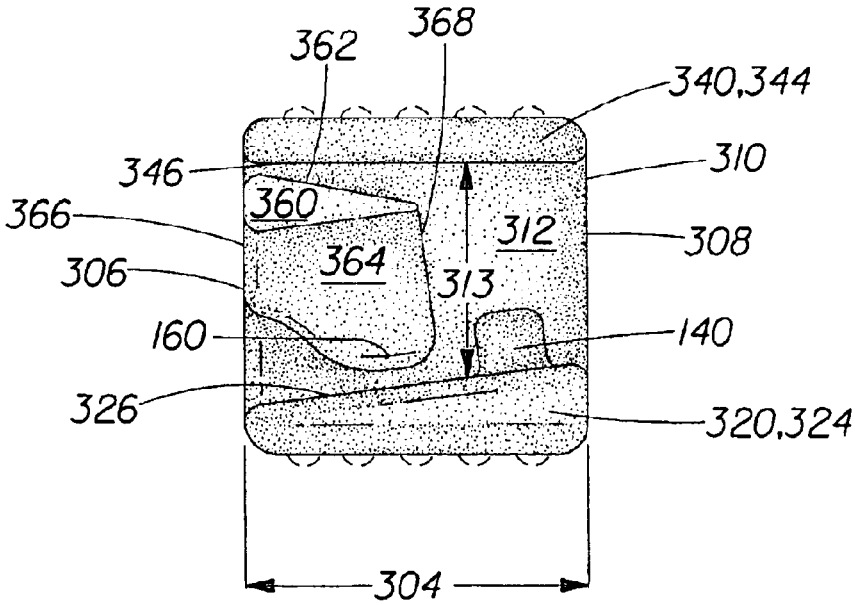
FIG. 7*b* is side view along the length of the slider depicted in FIG. 7*a*.

In an alternate embodiment shown in FIGS. 7*a* and 7*b*, the slider 300 comprises a third elongate member 340 having a proximal end 342 depending from the first surface 312 of the base 310, a distal end 344, and an internal surface 346. The third elongate member 340 is spaced apart from the first and second elongate members 320, 330 with the second elongate member 330 being interposed between the first and third elongate members 320, 340.

The first and third elongate members 320, 340 cooperate to perform the closing operation of the slider 300. The internal surface 346 of the third elongate member 340 interfaces with the non-interlocking bulbous surface 47 of the recessed element 44 while the internal surface 326 of the first elongate member 320 interfaces with the bead 82 forming the track on the bottom side 24 of the flange 20. The internal surface 326 of the first elongate 320 is tapered so that the spacing 313 between the internal surface 326 of the first elongate member 320 and the internal surface 346 of the third elongate member 340 varies along the width 304 of the slider from a maximal distance at the opening end 306 to a minimal proximal distance at the closing end 308 forming a converging channel therebetween. The measure of the minimal proximal distance is designed to bias the interlocking elements 42, 44 of the reclosable fastener 40 into engagement with one another.

Figure 8A:
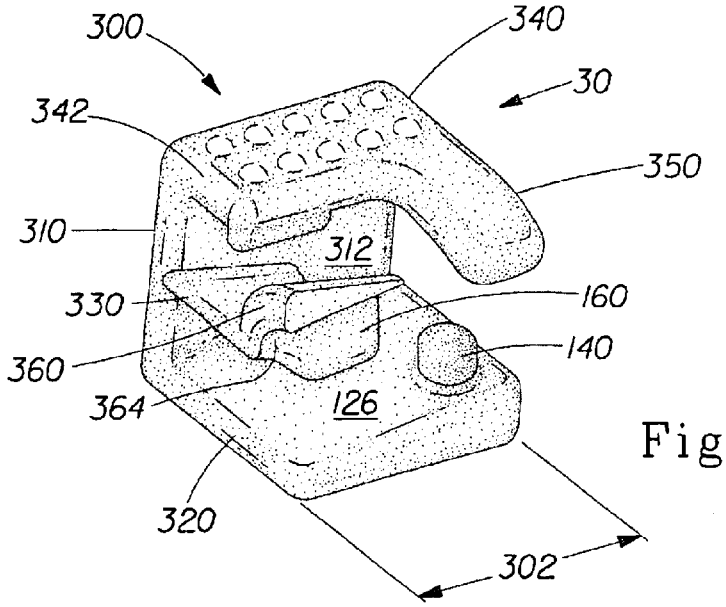
FIG. 8*a* is a perspective view of a modified configuration of the slider embodiment illustrated in FIGS. 7*a*–7*b*.
Figure 8B:
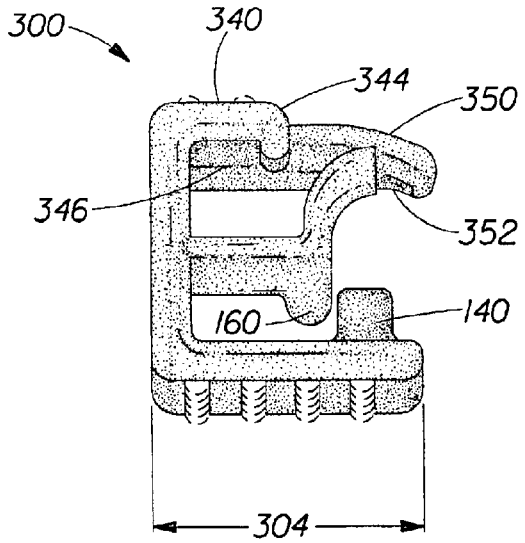
FIG. 8*b* is a side view along the width of the slider depicted in FIG. 8*a* showing the opening end of the slider.
Figure 8C:
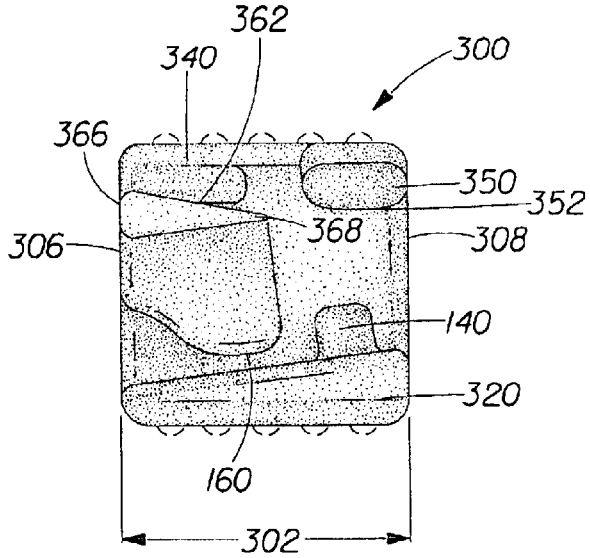
FIG. 8*c* is side view along the length of the slider depicted in FIG. 8*a*.

In order to minimize frictional contact between the slider 300 and the reclosable fastener 40, the third elongate member 340 may be modified as shown in FIGS. 8*a*–8*c*. The third elongate member 340 may be shorter than the first elongate member 320 and comprise a finger member 350 disposed at the distal end 344 of the third elongate member 340. The finger member 350 is positioned adjacent to the closing end 308 of the slider 300, projecting parallel to the width 304 thereof.

Figure 9A:
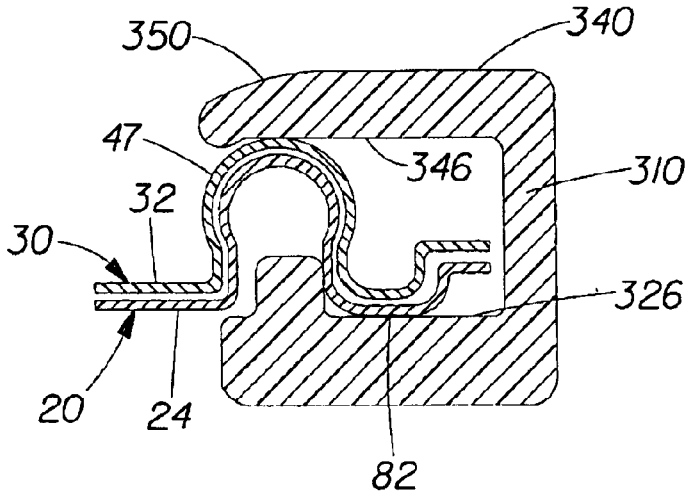
FIG. 9*a* is a cross sectional view of the closing end of the slider depicted in FIGS. 8*a*–8*c* shown slidably attached to a reclosable fastener in the closing configuration.

As further illustrated in FIG. 9*a*, the finger member 350 comprises an internal surface 352 which interfaces with the top side 32 of the cover 30, particularly, the non-interlocking bulbous surface 47 of the recessed element 44. At the same time, the internal surface 326 of the first elongate member 320 interfaces with the bottom side 24 of the flange 20, particularly, the bead 82 forming the track 46 along side of the opened end 41 of the protruded element 42 of the reclosable fastener 40.

Since the closing operation occurs primarily at the closing end 308 of the slider, the shorter third elongate member 340 can minimize contact with the fastener while the finger member 350 cooperates with the first elongate member 320 to bias the interlocking elements 42, 44 of the fastener 40 into engagement with one another. In order to provide better conformity with the non-interlocking bulbous surface 47 of the recessed element 44, the internal surface 352 of the finger member 350 may be curved concave towards the first elongate member 320.

To perform the opening operation for the embodiments illustrated in FIGS. 7*a*–7*b* and 8*a*–8*c*, a wedge 360 is interposed between the first and third elongate members 320, 340. As shown, the wedge 360 may be disposed at the distal end 334 of the second elongate member 330. The wedge 360 is tapered such that the external surface 362 of the wedge 360, opposite the internal surface 346 of the third elongate member 340, is sloped towards the first elongate member 320 from a first end 366 adjacent the opening end 306 of the slider 300 to a second end 368 approaching the closing end 308 of the slider 300. The cross section of the wedge 360 decreases from the first end 366 to the second end 368.

Figure 9B:
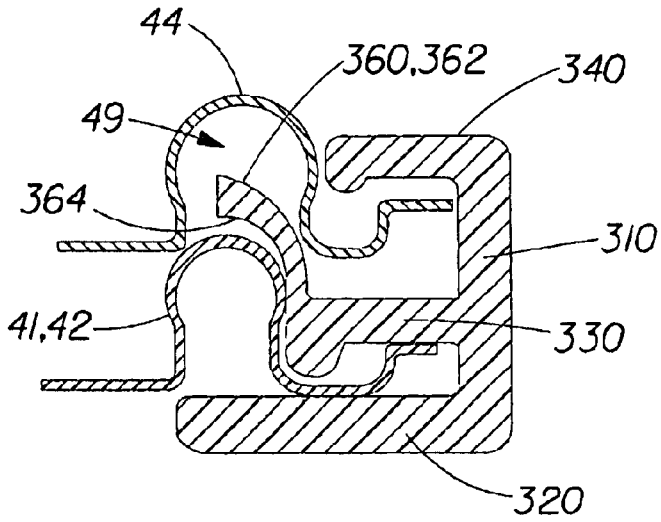
FIG. 9*b* is a cross sectional view of the opening end of the slider depicted in FIG. 8*a*–8*c* shown slidably attached to a reclosable fastener in the opening configuration.

In its assembled configuration illustrated in FIG. 9*b*, the wedge 360 is interposed between the interlocking elements 42, 44 of the reclosable fastener 40 with the internal surface 364 of the wedge 360 partially enclosing the bulbous interlocking surface 41 of the protruded element 42 while the external surface 362 of the wedge 360 interfaces with the groove 49 of the recessed element 44. In order to provide better conformity with the two interlocking elements 42, 44 the internal surface 364 may be concave towards the first elongate member 320 while the external surface 362 may be frustoconical.

So that the wedge 360 performing the opening function does not interfere with the aforementioned features performing the closing operation and vice versa, the second end 368 of the wedge 360 is spaced apart from the closing end 308 of the slider. Preferably, the second end of the wedge is spaced a predetermined distance from a plane disposed at the closing end 308 of the slider 300 defined by the minimal proximal distance between the internal surface 326 of the first elongate member 320 and the internal surface 346 of the third elongate member or internal surface 352 of the finger member 350, depending on the embodiment.

The sliders employed in the containers according to the present invention are preferably injection molded from high density polyethylene. However, one skilled in the art would recognize that such sliders may be manufactured from any moldable or machinable material utilizing machining or molding operations known in the art.

In yet another embodiment of the current invention, the invention is directed to a rigid, elongate reclosable fastener including interlocking protruded and recessed portions, a slider and a track for the slider. The track defines a travel path lying in more than one plane. The travel path has vector components extending in each of mutually orthogonal X, Y and Z directions. The slider is slidably attached to at least one of the interlocking portions and may be moved along the track to open and close the reclosable fastener. The slider may be attached, but may also be removable, in additional embodiments as would be obvious to one skilled in the art. This embodiment may be appropriate where the fastener is part of a jacket. The fastener could attach the ends of the jacket creating a sleeve. The sleeve could be used for insulation or as a protective covering. Further, the rigid, elongate reclosable fastener may be used as any other fastening means as would be obvious to one skilled in the art, such as on a tent or for a removable/reusable cast.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising a rigid, elongate reclosable fastener, a slider and a track for the slider, the track comprising a first track and a second track, wherein at least a portion of the first track is congruent to and contacts at least a portion of the second track whenever the reclosable fastener is closed, the track defining a travel path lying in more than one plane, the travel path having vector components extending in each of mutually orthogonal X, Y and Z directions, wherein the slider is slidably attached to the reclosable fastener and moved along the track to open and close the reclosable fastener.

2. The container according to claim 1 wherein the slider is adapted to close the rigid, elongate reclosable fastener when moved in a first direction along the travel path and is adapted to open the reclosable fastener when moved in a second direction opposite the first direction along the travel path.

3. The container according to claim 2 wherein the slider imparts forces to the fastener in a direction orthogonal to the travel path at any given point along the travel path to open or close the fastener as the slider moves along the track.

4. The container according to claim 2 wherein the reclosable fastener comprises interlocking protruded and recessed elements.

5. The container according to claim 4 wherein the slider is adapted to separate the recessed element from the protruded element by moving in the second direction.

6. The container according to claim 1 having a height lying in the Z-direction and further wherein the track extends in the Z-direction a distance less than the height of the container.

7. The container according to claim 6 further comprising a collapsible portion below the track.

8. The container according to claim 1 wherein the travel path is in two orthogonal planes, the first plane defined by the X and Y directions and the second plane defined by the X and Z directions.

9. The container according to claim 8 wherein the first plane and second plane are joined at a transition region having an arc.

10. The container according to claim 1 wherein the slider comprises first and second elongate members extending from a base, a pivot disposed perpendicular to the first elongate member and projecting toward the second elongate member, and a tracking member disposed perpendicular to the second elongate member and projecting towards the first elongate member, wherein the pivot interfaces with a first edge of the track and the tracking member interfaces with a second edge of the track.

11. The container according to claim 1 wherein the track comprises a fastening portion formed on the reclosable fastener and at least one auxiliary track deviating from the reclosable fastener and adapted for parking the slider.

12. The container according to claim 11 wherein the track further comprises a first auxiliary track for parking the slider after closing the reclosable fastener and a second auxiliary track for parking the slider after opening the reclosable fastener.

13. The container according to claim 1 further comprises a pour spout.

14. A container comprising:

a cover extending in at least two planes;

a container body adapted for receiving the cover and including a flange having a protruding element;

a track comprising a first track and a second track, wherein at least a portion of the first track is congruent to and contacts at least a portion of the second track whenever the reclosable fastener is closed, the track defining a travel path lying in more than one plane, at least partially defined by the flange; and a slider, at least a portion of the slider being disposed in the track, the slider adapted to close the cover on the container body when moved in a first direction along the track and adapted to open the cover from the container body when moved in a second direction opposite the first direction along the track.

15. The container according to claim 14 wherein the flange further includes a flange slot in the top side of the flange forming a flange bead on the bottom side of the flange and the cover includes a cover slot in the top side of the cover.

16. The container according to claim 15 wherein the track comprises the flange bead and the cover slot when the slider is moved along the flange in the first direction.

17. The container according to claim 15 wherein the track comprises the flange bead and the flange slot when the slider is moved along the flange in the second direction.

18. The container according to claim 14 wherein the cover further includes a recessed element for forming a closure with the protruding element of the flange.

19. The container according to claim 18 wherein the closure is a seal.

20. The container according to claim 14 wherein the cover extends in two planes and the two planes are substantially orthogonal.

21. The container according to claim 20 wherein the track has an arc at the interface between the two planes defined by the lid.

22. The container according to claim 14 wherein the cover is hingedly attached to the container.

23. A container comprising:

a cover;

a container body;

a reclosable fastener disposed between the cover and the container body, the reclosable fastener adapted to provide a seal therebetween;

a track comprising a cover track and a body track, wherein at least a portion of the cover track is congruent to and contacts at least a portion of the body track whenever the reclosable fastener is closed, the track defining a travel path lying in a three dimensional space defining orthogonal X, Y and Z directions, the track arranged at least partially congruent with the reclosable fastener; and a slider, at least a portion of the slider being disposed in the track and moved along the travel path to seal or unseal the reclosable fastener.

24. A rigid, elongate reclosable fastener comprising: interlocking protruded and recessed portions; a slider; and a track for the slider, the track comprising a first track and a second track, wherein at least a portion of the first track is congruent to and contacts at least a portion of the second track whenever the reclosable fastener is closed, the track defining a travel path lying in more than one plane, the travel path having vector components extending in each of mutually orthogonal X, Y and Z directions, wherein the slider is slidably attached to at least one of the interlocking portions and moved along the track to open and close the reclosable fastener.

25. A container comprising a rigid, elongate reclosable fastener, a slider and a track for the slider, the track defining a travel path lying in more than one plane, the travel path having vector components extending in each of mutually orthogonal X, Y and Z directions, wherein the slider is slidably attached to the reclosable fastener and moved along the track to open and close the reclosable fastener and wherein the track comprises a fastening portion formed on the reclosable fastener and at least one auxiliary track deviating from the reclosable fastener and adapted for parking the slider.

26. The container according to claim 25 wherein the track further comprises a first auxiliary track for parking the slider after closing the reclosable fastener and a second auxiliary track for parking the slider after opening the reclosable fastener.

* * * * *

UNITED STATES PATENT AND TRADEMARK OFFICE

CERTIFICATE OF CORRECTION

PATENT NO. : 6,722,520 B2
DATED : April 20, 2004
INVENTOR(S) : Matthew Todd Hupp and Daniel Raymond Cerone It is certified that error appears in the above-identified patent and that said Letters Patent is hereby corrected as shown below:

Column 5,
Line 12, delete “comers” and insert -- corners --.
Line 32, delete “U.S. Pat. No. 5,871,067,” and insert -- U.S. Pat. No. 5,871,607, --.

Signed and Sealed this

Twenty-ninth Day of June, 2004

JON W. DUDAS
*Acting Director of the United States Patent and Trademark Office*